US005115909A

United States Patent [19]

Hull et al.

[11] Patent Number: 5,115,909

[45] Date of Patent: May 26, 1992

[54] COMBINATION MONEY CLIP

[76] Inventors: Harold L. Hull, 401 Canyon Way #43, Sparks, Nev. 89434; Darin S. Hanson, P.O. Box 1301, Winnemucca, Nev. 89445

[21] Appl. No.: 709,274

[22] Filed: Jun. 3, 1991

[51] Int. Cl.[5] ..... A45G 11/32; A45G 15/00; A45G 1/06

[52] U.S. Cl. ..... 206/38; 150/137

[58] Field of Search ..... 150/137; 206/37.4, 38

[56] References Cited

U.S. PATENT DOCUMENTS

| | | | |
|---|---|---|---|
| D. 283,844 | 5/1986 | Saad et al. | D2/430 |
| 3,027,995 | 6/1961 | Littman | 206/38 |
| 3,220,452 | 3/1964 | Mintzes et al. | 150/38 |
| 3,447,171 | 6/1969 | Eyer | 7/1 |
| 3,555,623 | 4/1968 | Cocchiaraley | 24/81 |
| 3,596,757 | 8/1971 | Cocchiaraley | 206/81 |
| 3,623,193 | 6/1970 | Rikard | 24/261 PC |
| 3,861,002 | 1/1975 | Gordan | 24/81 |
| 4,183,019 | 1/1980 | Lekhtman | 340/539 |
| 4,540,034 | 9/1985 | Young | 150/137 |
| 4,675,953 | 6/1987 | Higgs | 24/499 |
| 4,768,648 | 9/1988 | Glass | 206/38 |
| 4,784,199 | 11/1988 | Wise | 150/137 |
| 4,903,376 | 2/1990 | Rousseau | 150/137 |
| 4,903,745 | 2/1990 | Roman | 150/137 |

*Primary Examiner*—William I. Price

[57] ABSTRACT

A money clip, made from clear extruded plastic, which is adapted to hold not only currency but has a compartment to hold a document such as a driver's license or credit card and may also have a pouch affixed to one of its sides to hold a spare emergency key such as a car door or house key.

11 Claims, 1 Drawing Sheet

FIG 1
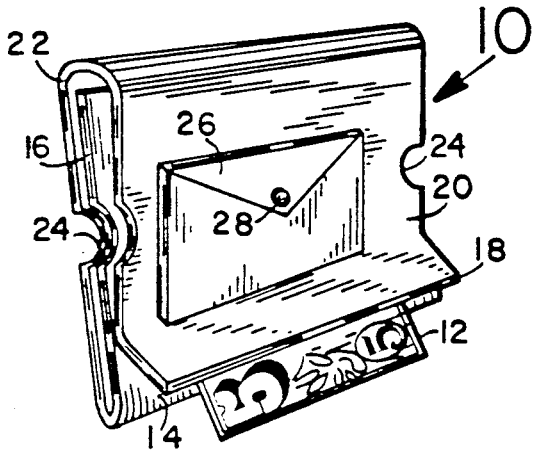
FIG 2
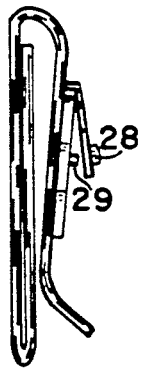
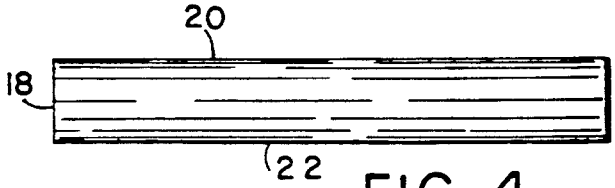
FIG 4
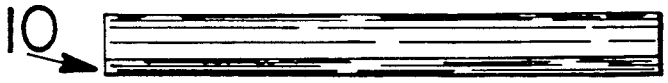
FIG 3
FIG 5
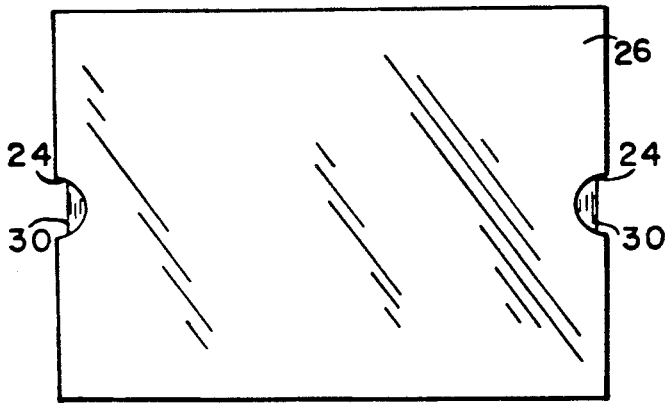

COMBINATION MONEY CLIP

FIELD OF THE INVENTION

This invention relates to money clips and more particularly to a money clip that is a combination money clip, document holder and spare key holder.

BACKGROUND OF THE INVENTION

In the past, a number of combinations involving a money clip in conjunction with another functional item has been taught such as U.S. Pat. No. 4,768,648 which combines a money clip money clip and a golf shoe calk maintenance kit, or the combination money clip and change box of U.S. Pat. No. 3,027,995, however, none of these teach the combination or advantages as taught by the present invention.

SUMMARY OF THE INVENTION

It is, therefore, a primary object to provide a money clip which has other functions beside simply holding paper currency.

Another object is to provide a money clip which may be made from an extruded material such as plastic and which can then be cut off to size, thus reducing costs substantially.

Another specific object is to provide a money clip which may be made of a clear plastic or the like and which functions not only as a money clip but contains a compartment in which a document such as a driver's license, credit card or other identification documents can be displayed.

Another important object is to provide an access indent in the document compartment to facilitate grasping the document to withdraw it readily from the compartment.

Yet another object is to make the device from a material having a memory thus eliminating the necessity of springs or other clamping means to hold not only the document securely, but to hold the currency securely.

Also, another object is to make the currency compartment of a size to hold a substantial amount of currency.

Still another important object is to form the opening to the currency compartment at an angle such as a V shape to allow easy access to the currency compartment.

Yet another object is to provide an additional pouch affixed to the currency outside wall which is of a size and shape to hold at least one key such as a car door or house door key.

Another object is to make the device of a size which is hand and pocket friendly but which is not easily remove by a professional pick-pocket.

Other objects and advantages will become apparent when taken in consideration with the following drawings and specifications.

BRIEF DESCRIPTION OF THE DRAWINGS

FIG. 1 is a perspective view of the device.

FIG. 2 is an end view of the device.

FIG. 3 is an edge view showing the substantially V opening.

FIG. 4 is an opposite edge view to FIG. 3.

FIG. 5 is a side view of the device showing a document in place.

DETAILED DESCRIPTION OF THE DRAWINGS

Referring now in detail to the drawings wherein like characters refer to like elements throughout the various views, 10 of FIG. 1 is an over all view of the combination money clip with 12 being a folded 5 dollar bill which has been inserted through the substantially v shaped opening 14, the opening being formed by the center wall 16 and angled lip 18 of first outer wall 20, with second outer wall 22 and center wall 16 forming a document compartment, 24 being indentations in walls 20, 16 and 22, respectively. 26 is substantially a pouch made of leather or other cloth like material suitably affixed such as by gluing or double sided tape to the first outer wall 20 and is of a size and shape to hold at least one key with 28 and 29, respectively, being components of a closure means such as a snap. FIG. 5 shows a document 30 captured between center wall 16 and second outer wall 22 and being readily accessible through the indentations 24. In the shown embodiment the combination money clip is made from an opaque material such as colored plastic but may be made of clear plastic or other clear material in order to display the enclosed document.

It will now be seen that we have provided a combination money clip which can easily hold a large quantity of bills while at the same time holding and displaying a document such as a driver's license and also having a pouch or the like to hold a key such as a car door or house key and which is of a size and shape which readily fits into a pocket or purse but is not easily removed by a pick-pocket.

It will also be seen that the device can be made of one continuous, substantially rectangular, opaque or clear material, which, being folded from each end over on itself, provides two compartments, one for holding currency in a tensioned position while the other holds a document with the document(s) easily grasped through the multiple indents in the edges of the device.

It will also be noted that by using a material having a memory that many parts such as springs, hinges, rivets, etc., have been eliminated from the prior art and may be made from extruded material having a memory and cut off to size.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by letters patent is:

1. A money clip comprising: a substantially rectangular base, said base being made of a material having a memory, said base having a first end section, a second end section and a center section, said first end section being folded substantially parallel to said center section forming a first compartment with a first common edge, said first common edge forming substantially a half-circle, said first compartment being adapted to hold a document, said second end section being folded over on said first end section forming a second compartment with a second common edge, said second common edge forming substantially a half-circle, said second compartment being adapted to hold currency, said second end section having an outwardly extending section at it's outer exposed extremity, said outwardly extending section forming a lip, said lip cooperating with said center section to form an entrance way to said second compartment, said entrance way being substantially a V, said second end section being tensioned toward said center section with said lip on it's inner extremity being in contact with said center section when in a closed position and being separated from said center section when in and open position, and said half-circle of said second common edge being larger in diameter than said half-circle of said first common edge.

2. The device of claim 1 in which said material having a memory is a resilient plastic.

3. The device of claim 2 is which said resilient plastic is clear.

4. The device of claim 1 in which said first compartment has indentations in it's outer un-common edges, whereby, said document may be grasped.

5. The device of claim 1 including a pouch, means to affix said pouch to said second end section, said pouch being of a size and shape to hold at least one key.

6. The device of claim 5 in which said pouch is made of leather.

7. The device of claim 5 in which said means to affix said pouch to said second end section is by glue.

8. The device of claim 5 is which said means to affix said pouch to said second end section is by two-way tape.

9. The device of claim 5 in which said pouch has closure means.

10. The device of claim 9 in which said closure means is a snap.

11. The device of claim 1 in which said material having a memory is extruded.

* * * * *